US007670210B2

(12) United States Patent
Annis

(10) Patent No.: US 7,670,210 B2
(45) Date of Patent: Mar. 2, 2010

(54) TOOL FOR WORKING ON A SURFACE

(75) Inventor: Kent V. Annis, Burnsville, MN (US)

(73) Assignee: Full Circle International, Inc., Burnsville, NY (US)

( * ) Notice: Subject to any disclaimer, the term of this patent is extended or adjusted under 35 U.S.C. 154(b) by 0 days.

(21) Appl. No.: 11/715,551

(22) Filed: Mar. 8, 2007

(65) Prior Publication Data

US 2007/0212993 A1 Sep. 13, 2007

Related U.S. Application Data

(60) Provisional application No. 60/780,653, filed on Mar. 9, 2006.

(51) Int. Cl.
*B24D 15/00* (2006.01)

(52) U.S. Cl. ..... 451/523; 451/490; 451/59

(58) Field of Classification Search ..... 451/59, 451/490, 514, 515, 520–525, 552, 557; 15/144.1, 15/144.2, 145, 228, 229.1, 229.2, 229.4, 15/229.6–229.8, 231–233
See application file for complete search history.

(56) References Cited

U.S. PATENT DOCUMENTS

| | | | | | |
|---|---|---|---|---|---|
| 1,501,192 | A | | 7/1924 | Severns | |
| 1,520,642 | A | * | 12/1924 | Giroux | 451/522 |
| 1,562,415 | A | * | 11/1925 | Newman | 451/503 |
| 2,112,593 | A | | 3/1938 | Campbell | |
| 2,417,680 | A | | 3/1947 | Decker | |
| 2,474,064 | A | | 6/1949 | Paul | |
| 2,663,979 | A | | 12/1953 | Sierchio | |
| 2,780,533 | A | | 2/1957 | Hurst | |
| 3,089,294 | A | | 5/1963 | Cowley | |
| 3,105,329 | A | | 10/1963 | Sgorbati, Sr. | |
| 3,123,946 | A | * | 3/1964 | Hoveland | 451/522 |
| 3,473,183 | A | * | 10/1969 | Ercoli et al. | 15/144.1 |
| 3,605,165 | A | * | 9/1971 | Burns | 15/210.1 |
| 3,717,896 | A | * | 2/1973 | Chase et al. | 15/210.1 |
| 3,760,450 | A | * | 9/1973 | Griffin et al. | 15/229.6 |
| 3,866,361 | A | * | 2/1975 | Mauck | 451/490 |
| 3,991,431 | A | * | 11/1976 | Thielen | 15/147.2 |
| 4,219,899 | A | * | 9/1980 | Zurawin et al. | 15/144.2 |
| 4,391,013 | A | | 7/1983 | Janssen | |
| 4,399,170 | A | | 8/1983 | Janssen | |
| 4,424,603 | A | | 1/1984 | Balint et al. | |
| 4,617,767 | A | | 10/1986 | Ali | |
| 4,625,462 | A | | 12/1986 | Fushiya et al. | |

(Continued)

FOREIGN PATENT DOCUMENTS

DE 31 05 426 A1 8/1982

(Continued)

OTHER PUBLICATIONS

International Search Report (7 pgs.).

*Primary Examiner*—Dung Van Nguyen
(74) *Attorney, Agent, or Firm*—Brooks, Cameron & Huebsch PLLC

(57) ABSTRACT

An embodiment of a tool includes a tool body. A base is coupled to the tool body and a pad is coupled to the base. The tool includes a working material coupled to the pad.

22 Claims, 10 Drawing Sheets

U.S. PATENT DOCUMENTS

| | | | | | |
|---|---|---|---|---|---|
| 4,714,644 | A | | 12/1987 | Rich | |
| 4,782,632 | A | | 11/1988 | Matechuk | |
| 4,825,597 | A | | 5/1989 | Matechuk | |
| 4,829,719 | A | | 5/1989 | Braselton | |
| 4,848,037 | A | | 7/1989 | Happe | |
| 4,885,876 | A | * | 12/1989 | Henke | 451/503 |
| 4,966,609 | A | | 10/1990 | Callinan et al. | |
| 5,007,206 | A | | 4/1991 | Paterson | |
| 5,016,042 | A | | 5/1991 | Yamamoto et al. | |
| 5,056,268 | A | | 10/1991 | Wolff | |
| 5,103,599 | A | | 4/1992 | Carlson | |
| 5,168,672 | A | | 12/1992 | Gregoire, Sr. | |
| 5,201,785 | A | | 4/1993 | Nagano | |
| 5,239,783 | A | | 8/1993 | Matechuk | |
| 5,283,988 | A | * | 2/1994 | Brown | 451/524 |
| 5,309,681 | A | | 5/1994 | Cheney et al. | |
| 5,313,746 | A | | 5/1994 | Zarriello | |
| D353,313 | S | | 12/1994 | Stiles | |
| D354,666 | S | | 1/1995 | Kriebel | |
| 5,419,087 | A | | 5/1995 | Haddy | |
| 5,527,212 | A | | 6/1996 | Bowen et al. | |
| 5,545,080 | A | | 8/1996 | Clowers et al. | |
| 5,605,500 | A | | 2/1997 | Matechuk | |
| 5,607,345 | A | | 3/1997 | Barry et al. | |
| 5,662,519 | A | | 9/1997 | Arnold | |
| 5,690,545 | A | | 11/1997 | Clowers et al. | |
| 5,791,977 | A | | 8/1998 | Clowers et al. | |
| 5,885,145 | A | | 3/1999 | O'Mara | |
| 5,895,316 | A | | 4/1999 | Williams | |
| 5,947,803 | A | | 9/1999 | Gruner | |
| 5,962,102 | A | | 10/1999 | Sheffield et al. | |
| 6,053,805 | A | | 4/2000 | Sanchez | |
| 6,059,850 | A | | 5/2000 | Lise et al. | |
| 6,061,864 | A | * | 5/2000 | Ensson | 15/147.1 |
| 6,095,911 | A | | 8/2000 | Edens | |
| 6,109,811 | A | | 8/2000 | Song | |
| 6,227,959 | B1 | | 5/2001 | Beaudry | |
| 6,267,658 | B1 | | 7/2001 | Ali et al. | |
| 6,296,558 | B1 | | 10/2001 | Poole et al. | |
| 6,325,708 | B1 | | 12/2001 | Miles | |
| 6,361,424 | B1 | | 3/2002 | Manor et al. | |
| 6,406,365 | B1 | | 6/2002 | Ueno | |
| 6,468,141 | B1 | | 10/2002 | Conboy et al. | |
| 6,500,057 | B1 | | 12/2002 | Medina | |
| 6,523,214 | B1 | | 2/2003 | Kaiser | |
| 6,524,175 | B2 | | 2/2003 | Beaudry et al. | |
| 6,634,937 | B1 | | 10/2003 | Edwards et al. | |
| 6,659,852 | B1 | | 12/2003 | Wettstein et al. | |
| D497,092 | S | | 10/2004 | McCarthy | |
| 7,011,573 | B2 | * | 3/2006 | McArthur et al. | 451/523 |
| 7,063,474 | B2 | | 6/2006 | DeFields et al. | |

FOREIGN PATENT DOCUMENTS

| | | | |
|---|---|---|---|
| EP | 0351273 | A1 | 1/1990 |
| GB | 846413 | | 8/1960 |
| GB | 1238006 | | 7/1971 |
| GB | 2298379 | | 9/1996 |
| GB | 2299038 | | 9/1996 |
| WO | WO 02/45905 | A1 | 6/2002 |

* cited by examiner

TOOL FOR WORKING ON A SURFACE

RELATED APPLICATIONS

This application claims the benefit of U.S. Provisional Application No. 60/780,653, filed Mar. 9, 2006, the entire content of which is incorporated herein by reference.

INTRODUCTION

Tools have been utilized in many fields for working the surface of a material, such as sanding, polishing, grinding, and painting, among others. For example, when fabricating a structure, such as a wall or ceiling in a building, oftentimes it is useful to utilize a sanding device to smooth the surface of the structure. In the field of sanding devices, for example, several devices have been proposed.

One proposed sanding device has an elongate rectangular head. This head is designed to accommodate a standard sized elongate sheet of sand paper. This allows the tool to have an easily available supply of sand paper that can be used with the device.

However, when such a device is manipulated, the device tends to flip onto its elongate sides and can damage the surface due to its narrow configuration and the location of the attachment of the elongate handle, which is positioned high above the center of the head in relation to the device's width. For example, the corners or edges of the device can gouge the surface.

This can require filling and/or additional sanding to remove the damage. In addition, when sanding a corner area, one of the two abutting walls of the corner can be inadvertently gouged due to contact with the edge of the device.

A device has also been proposed to aid in sanding corners that utilizes an acute isosceles triangular shape. However, since the isosceles triangle has a tall narrow profile, this device also has a narrow region near the attachment to the handle and encounters the same flipping problem.

Additionally, the angles of the triangle do not match that of most corners on wall surfaces, floor, and ceiling and, therefore, a corner of the device has to be moved around the area of the corner of the surface in order to completely work such an area. This approach can lead to uneven sanding and increases the risk of poking the corner of the device into one of the adjacent walls forming the corner.

Another device utilizes a motorized rotating head that rotates rapidly to reduce the number of passes the device must take over an area. These devices are larger and more cumbersome due to the mechanical motor assembly and have a circular, non-continuous "O" shaped working surface due to the need to have access to a bolt.

The bolt is seated in the center of the "O" defined by the working surface. The bolt is used to remove the working surface from the rotational axis of the device in order to remove the sanding or other type of working material mounted to the head.

This device takes a greater level of skill to master and if used improperly, can damage the surface by dishing to create swirl marks in the surface. Further, these devices also typically allow for replacement of the working surface, but other components of the devices are typically non-replaceable. In such instances, the tool may have to be replaced or brought in for service when one of its components is worn.

DETAILED DESCRIPTION

Embodiments of the present disclosure include devices having a number of layers and methods of using the same. These devices may be applicable to various fields, such as those described above, among others.

For example, various embodiments of the present disclosure provide working devices that reduce the potential for scoring one or more of the abutting walls at a corner. Some embodiments reduce the propensity for tipping of a body of a device on its side.

Further, in some embodiments, the edges are designed to reduce the risk of damage to an adjacent surface. Embodiments can also provide a sanding surface for scoring an adjacent surface, e.g., a wall and/or ceiling, if desired. Also, some embodiments can include a rounded edge and/or a serrated edge which may be used to sand and/or score an adjacent working surface such as a wall and/or ceiling surface.

As discussed above, a working device can be utilized in many fields depending upon what working material is utilized. And, although the focus of the present discussion may be directed toward use as a sanding tool, the field of sanding is utilized as an example in this disclosure to illustrate some of the benefits of the various embodiments. However, the various embodiments should not be limited to the field of sanding.

In some embodiments of a tool for working on a surface, the tool includes a tool body, a base coupled to the tool body, a pad coupled to the base, and a working material coupled to the pad. In various embodiments, the tool body, the base, the pad, and/or the working material are each releasably coupled with an attachment surface. In various embodiments, at least one of the attachment surfaces includes a hook and loop fastening material. According to various embodiments, the base can include a surface defining a recessed portion to receive the tool body.

In various embodiments, the tool body can be a rigid tool body. In such embodiments, the tool body can be made of one or more metals and/or plastics, among other inflexible materials.

Figure 1A:
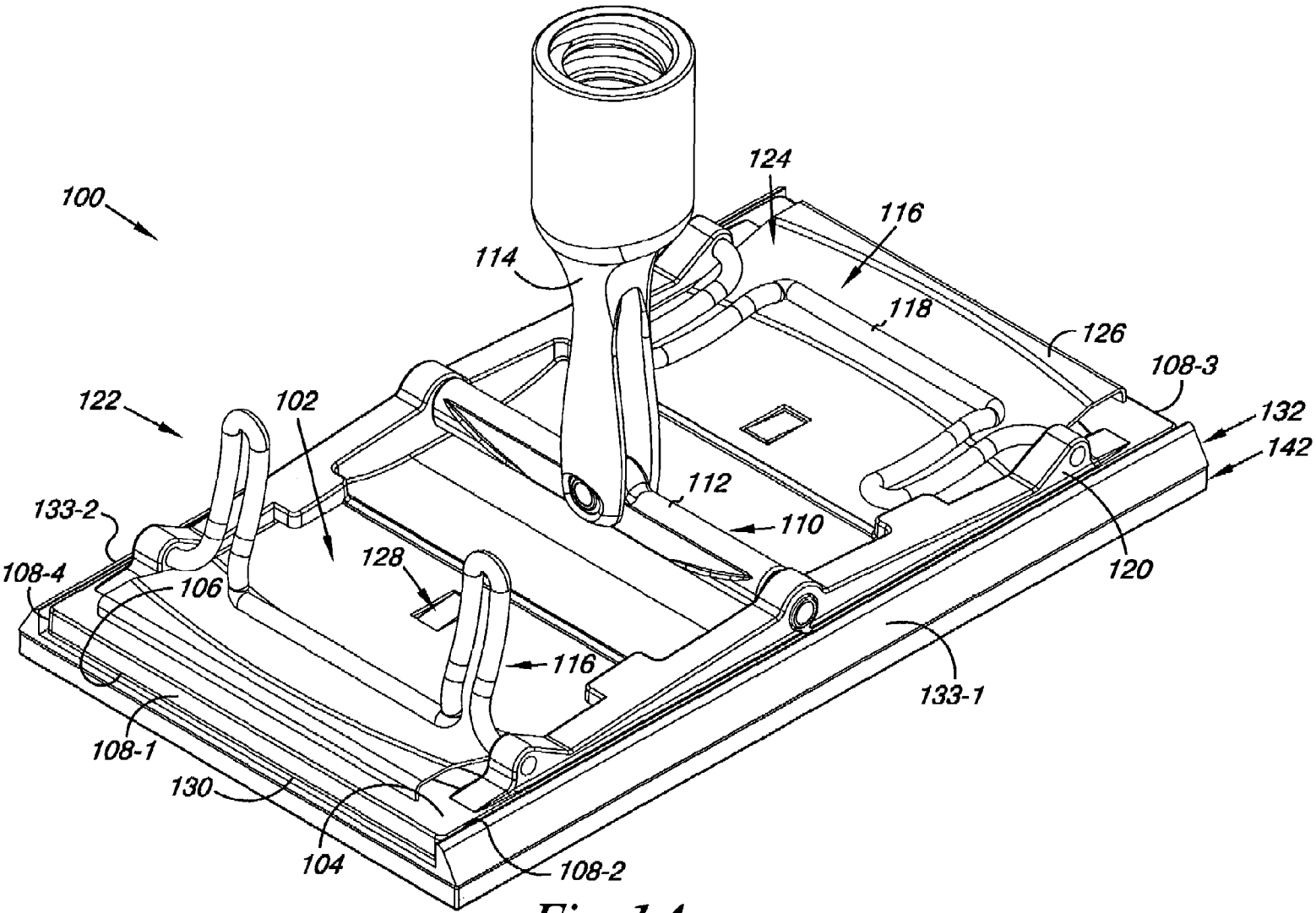
FIG. 1A illustrates a top perspective view of an embodiment of a tool.

FIG. 1A illustrates a top perspective view of an embodiment of a tool 100 of the present disclosure. In the various embodiments of the present disclosure, the tool is comprised of a number of components that can be releasably coupled to each other in layers.

It should be noted that the components that will be discussed herein can be implemented independently, or in various combinations, without departing from the functionality of the various tool embodiments. For example, in various embodiments, a pad, having a releasably coupled working material thereon, can be omitted from the tool, and the working material can be releasably coupled to a different component, as will be discussed in more detail below.

The present disclosure includes a number of tool and method embodiments. In various embodiments, the tool can include a tool body. The tool body can include a top and bottom surface. The top and bottom surface can each be connected by a number of side surfaces.

In some embodiments, the tool or a portion thereof, can be motorized. For example, a vibrating or rotating mechanism can be used to move the working material.

In various embodiments, the periphery of the tool body can include a variety of shapes. In some embodiments, for example, the periphery of the tool body is a polygon. For instance, in such embodiments, the periphery of the tool body can be a rectangle, a square, a pentagon, a hexagon, and other such shapes.

In various embodiments, the tool body can receive a handle pivotably coupled to the tool body to allow an operator of the tool to manipulate the tool and various components thereof. In some embodiments, the tool body can include a concave upper surface to which a pivotally coupled elongate handle (e.g., a pole type handle with a threaded end for pivotal attachment to the tool body) can be rotatably coupled.

This concave shape can be beneficial in reducing the propensity of the tool body to flip. The reduction is accomplished, for example, by lowering the coupling point of the handle and the tool body, among other factors.

In various embodiments, the tool can include a base releasably coupled to the tool body. In some embodiments, the base can include a surface defining a recessed portion to receive the tool body.

In various embodiments, the base can be formed of a flexible material. For example, the tool can include a flexible base releasably coupled to the tool body. In such embodiments, the flexible base can include a top surface defining a recessed portion sized to accommodate the bottom surface of the tool body.

In various embodiments, the base can include a top and bottom surface and a number of side surfaces. A number of the side surfaces of the base can be at non-right angles to the bottom surface of the base. For example, as shown in FIGS. 1A, 1B, 2A, and 2B, the base can include two surfaces that have a rectangular shape and a number of surfaces that have a trapezoidal shape and/or curved edges.

In various embodiments, the two surfaces of the base that have the rectangular shape can be the top and bottom surfaces and the number of surfaces of the base that have the trapezoidal and/or curved edges can be two side surfaces. Embodiments are not limited to these examples.

For instance, in some embodiments, only one side surface of the base may be at a non-right angle to the bottom surface of the base. Also, in some embodiments, more than two side surfaces of the base may be at non-right angles to the bottom surface of the base. For example, in some embodiments, four side surfaces of the base can be trapezoidal or curved (e.g., rounded), or a combination thereof.

In some embodiments, the side surfaces can be angled as discussed above. For instance, in some embodiments, the base has two side surfaces and where each side surface is angled at twenty degrees from a bottom surface of the base. However, embodiments of the present disclosure are not limited to bases having angled side surfaces or to particular angles of the side surfaces.

In various embodiments, the tool can include a pad releasably coupled to the base. In some embodiments, the pad can include a top and bottom surface and a number of side surfaces. A number of the side surfaces of the pad can be at non-right angles to the bottom surface of the pad.

For example, in various embodiments, the pad can include two surfaces that have a rectangular shape and four surfaces that have a trapezoidal shape. In such embodiments, the two surfaces that have the rectangular shape can be the top and bottom surfaces and the four surfaces that have the trapezoidal shape include the side surfaces. An example of such a shape is a truncated pyramid (in a truncated pyramid, the rectangular shapes are typically squares).

In some embodiments, the pad can have two side surfaces and where each side surface is angled at twenty degrees from a bottom surface of the pad. However, embodiments of the present disclosure are not limited to pads having angled side surfaces or to particular angles of the side surfaces. Further, in some such embodiments, such pads can be combined with bases that have one or more angled side surfaces.

Figure 2A:
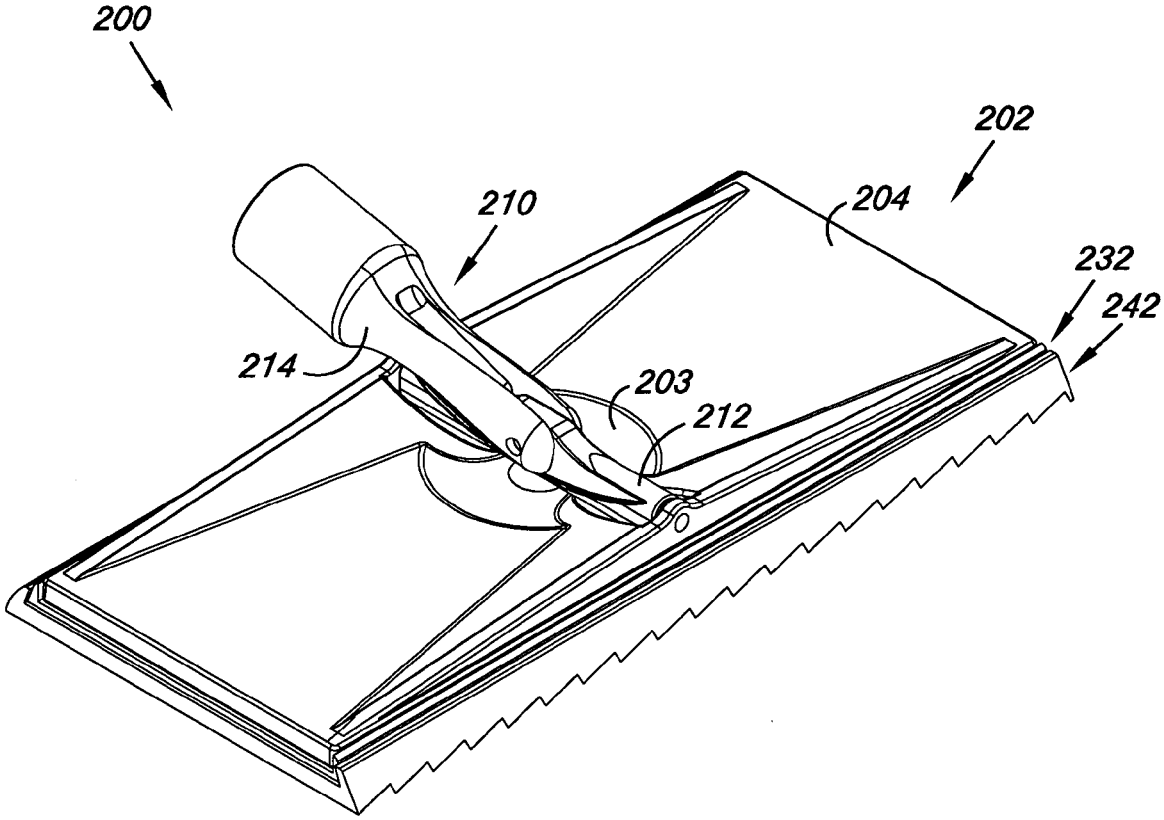
FIG. 2A illustrates a top perspective view of another embodiment of a tool.
Figure 2B:
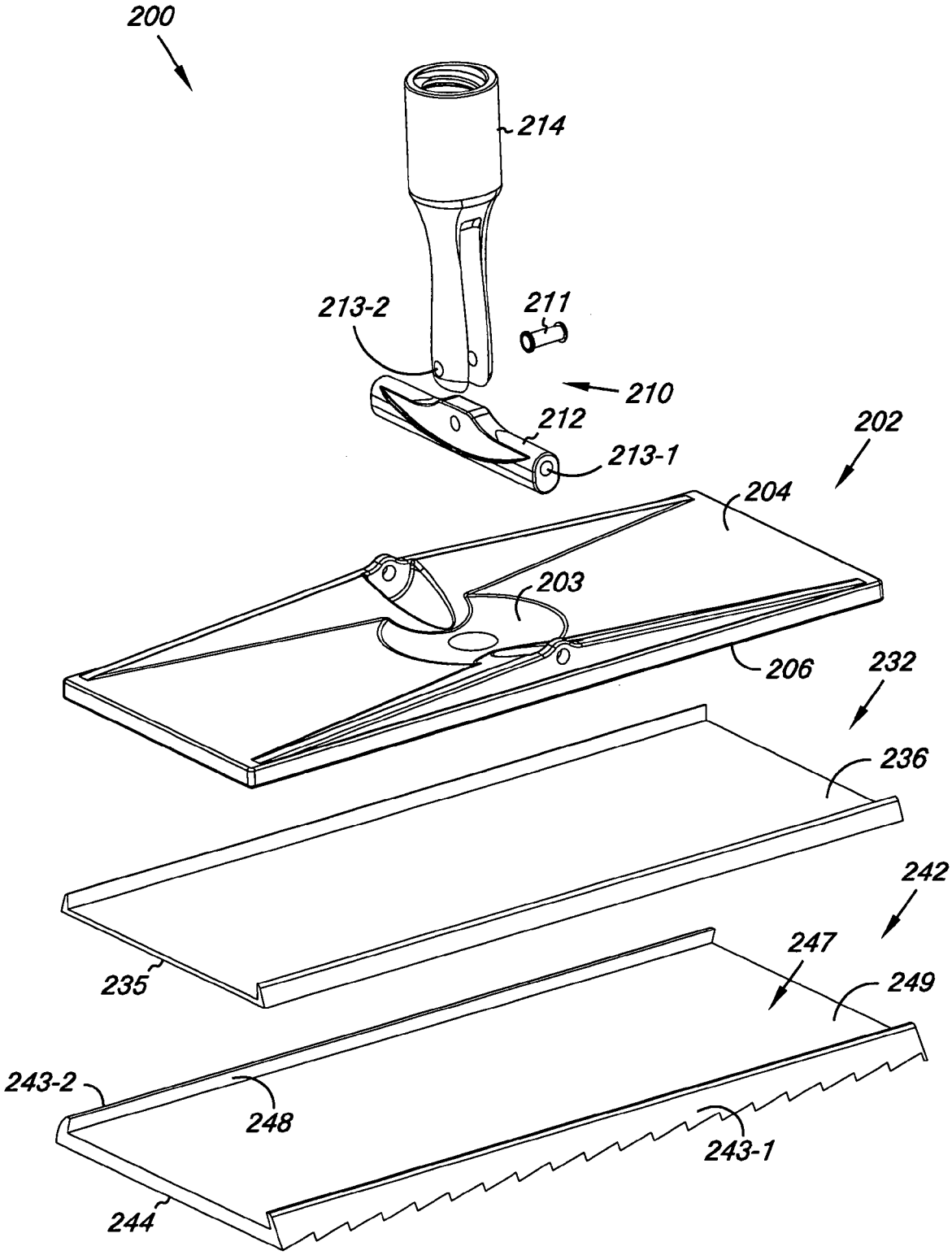
FIG. 2B illustrates an exploded top perspective view of the embodiment of FIG. 2A.

In various embodiments, the pad can be sized to include a periphery at least as large as a periphery of the base. In various embodiments, and as shown in FIGS. 2A and 2B, the pad can include a surface defining a recessed portion to receive the base.

The pad can be formed of a flexible material or a rigid material. For example, the tool can include a flexible pad releasably coupled to the tool base. In such embodiments, the flexible pad can include a top surface defining a recessed portion sized to accommodate the bottom surface and a side surface of the base.

In some embodiments, the pad can be smaller than the periphery of the base. For example, in such embodiments, a pad can be slightly smaller than the base.

In various embodiments, the pad can be releasably coupled to the base on an attachment surface. The tool can include a working material releasably coupled to the pad. In various embodiments, the working material can be selected from a group of materials including a polishing material, a grinding material, a painting material, and a sanding material, among others. In various embodiments, the tool can include one or more fasteners to receive a working material directly or indirectly releasably attached to the tool body selected from a variety of different fastening mechanisms, such as releasable adhesives, hook and loop fastening materials, a number of compression clamps, a number of bolts or screws, or bolt and nut fasteners, among others.

In various tool embodiments, one or more of the components of the tool (e.g., the tool body, the base, the pad, and/or the working material) can each be releasably coupled at an attachment surface. For example, an attachment surface can be used to releasably couple the various components of the tool to each other. For instance, in various embodiments, the attachment surface can include a hook and loop fastening material thereon. In some embodiments, a portion of the working material can wrap around the pad and attach between the base and the pad or to the tool body.

Figures 7A, 7B, 7C:
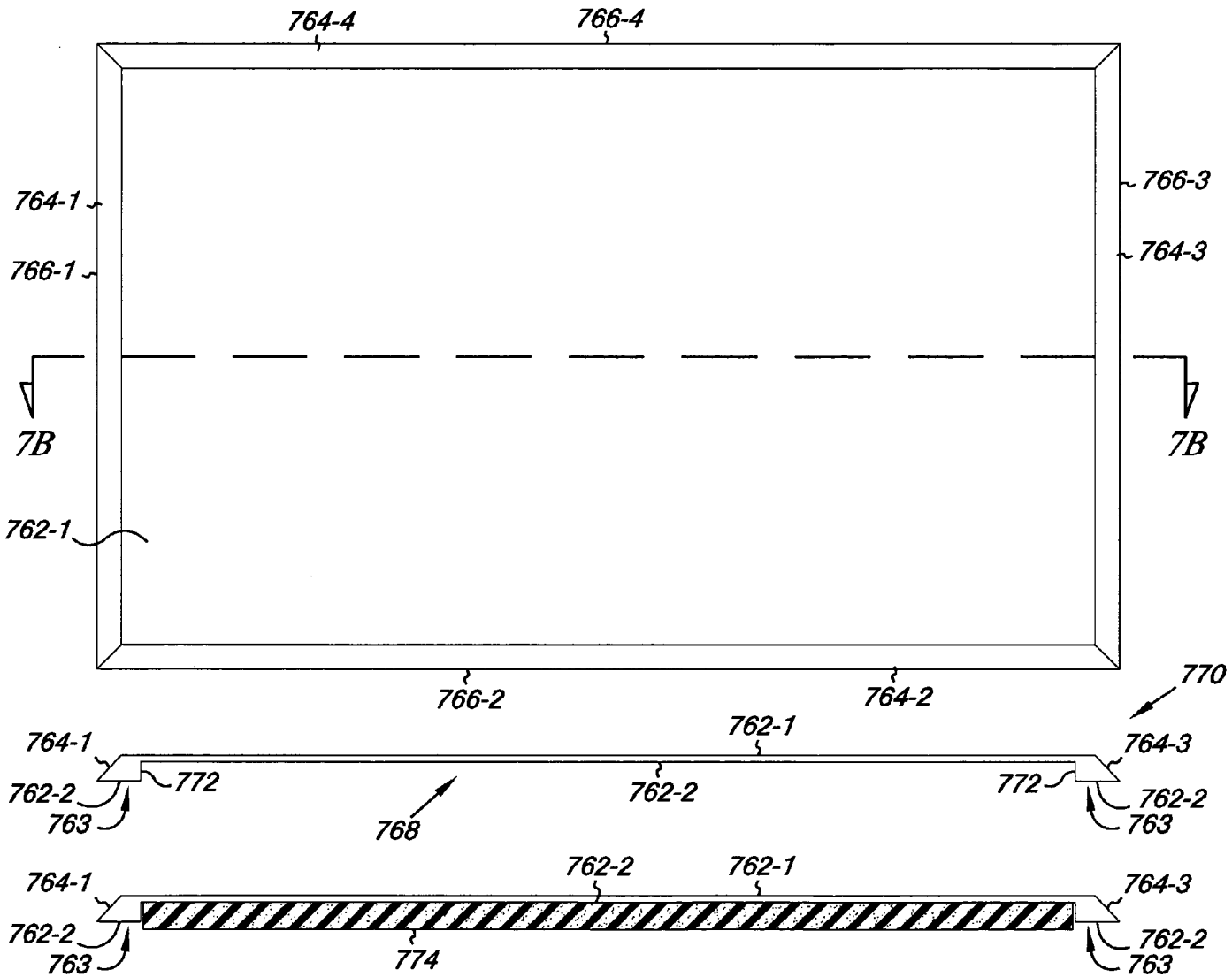
FIG. 7A illustrates a top view of an embodiment of a component of a tool.
FIG. 7B illustrates a cross-sectional view of an embodiment similar to that illustrated in FIG. 7A that includes a recess formed in the bottom surface of the component.
FIG. 7C illustrates a cross-section view of an embodiment similar to that illustrated in FIG. 7B that includes a filler material.

In some embodiments, and as shown in FIGS. 7A-7C, the tool can have a tool component releasably coupled to the tool body. In such embodiments, the tool component can include a bottom surface defining a recessed portion. Embodiments can include a filler material releasably coupled to the bottom surface of a component and the filler material may be positioned within the recessed portions of one or more tool components.

In various embodiments, the tool component is a pad. In some embodiments, the tool component is a base and the filler material is a pad. In various embodiments, the tool component can include a periphery formed of a material having a lower resiliency than the filler material.

The various embodiments of the present disclosure can be used in a number of ways. For example, in some embodiments, the tool can be applied to a working surface and advanced across the working surface in one or more directions.

Referring now to FIG. 1A, the figure illustrates a top perspective view of an embodiment of a tool 100. In the embodiment shown, the tool 100 includes a tool body 102. As stated above, the tool body 102 can be a rigid tool body and can be a variety of shapes and/or sizes. In the embodiment shown in FIG. 1A, the tool body 102 is a rectangular shape. In some embodiments, the tool body can be other shapes, for example, square, triangular, circular, elliptical, and can be other polygonal or irregular shapes (e.g., three sides straight, one side curved, a three sided shape having non-straight edges, etc.).

The tool 100 includes a number of components that stack above and/or below each other to form a number of layers of various components. In various embodiments, these components can have the same bottom surface shape as the tool body, or one or more of the components can have different bottom surface shapes.

For example, in some embodiments, the tool body 102 can be a rectangular shape while a base component, as will be discussed below, that can be coupled to the tool body 102, has a polygonal bottom surface shape. Embodiments can also have similar or different shaped top surfaces.

As shown in the embodiment illustrated in FIG. 1A, the tool body 102 includes a top surface 104 and a bottom surface 106. The top and bottom surfaces 104 and 106 are each connected by a number of side surfaces 108-1-108-4.

In various embodiments, the top surface 104 can accommodate a variety of mechanisms that aid the functioning of the tool 100. For example, in some embodiments, the top surface 104 of the tool body 102 can include a pivoting structure 110 to which a handle can be pivotably coupled. In the example shown, the pivoting structure 110 includes a two piece, two directional structure.

In this example, a first piece 112 having a first pivot point is connected to a second piece 114 having a second pivot point. In various embodiments, a handle can be coupled to the second piece 114, for example, by threading the handle to the second piece 114.

The first piece 112 allows the second piece 114 to pivot radially with respect to the attachment point of a handle coupled to the tool body 102. In this embodiment, the second piece 114 allows a handle to pivot radially with respect to the attachment point of the handle to the tool body 102, and generally perpendicular to the pivotal movement provided by the first piece 112.

The use of the two pieces 112 and 114 allows for the handle to achieve many positions with respect to the tool body 102. However, the embodiments of the present disclosure are not limited to the use of pivotable attachment pieces illustrated in the embodiment of FIG. 1A. For example, a ball joint, universal joint, or other joint type structure can be utilized.

Further, in some embodiments, the handle can be fixed with respect to, or onto, the tool body 102. For example, a handle can be formed as part of the tool body or can be attached thereto. In some embodiments in which an elongate handle is coupled to the tool body 102, the handle can provide for an increased range of motion or coverage area of tool 100.

In various embodiments, the top surface can include a fastening member to hold a working material in place. In the embodiment shown in FIG. 1A, the fastening member 116 includes an elongate member 118 pivotably attached to a spring pivot 120.

When the fastening member 116 is engaged, for example by moving it from a first position 122 to a second position 124, the elongate member 118 rotates about the spring pivot 120 and pushes a compression member 126 downward to secure a working material (e.g., sand paper, polishing paper, etc.) between the top surface 104 of the tool body 102 and the compression member 126. In some embodiments, the spring pivot 120 precludes the elongate member 118 from independently returning to the first position 122 and, thereby, precludes the working material from releasing from the tool 100 until the fastening member 116 is actuated by a user.

The working material can be secured to the tool 100 in various other manners as well. For example, in various embodiments, the top surface 104 can define openings 128 through which a bolt can extend.

In such an embodiment, a working material or other layer can be secured to the tool body 102 by passing a bolt through the working material and the openings 128 and tightening the working material or layer to the tool body using a nut, such as a wing nut, etc. The working material can also be maintained in position by frictionally holding one or more edges of the working material between two layered components of the tool. In some embodiments, working material can be secured to the tool by coupling the working material directly to a surface (e.g., an attachment surface) of a component of the tool, as will be discussed in more detail below.

A working material can be any type of material that can be utilized to perform work on a surface. Some examples of working materials include, but are not limited to, abrasive materials (e.g., sand paper and/or sanding screens), materials for the application of paint or stain, materials for grinding, and materials for polishing, among others.

In various embodiments, the tool 100 can include a first attachment surface 130 that releasably couples the tool body 102 to another component of the tool, such as a base 132, as will be discussed below with respect to FIGS. 1B-3C, for example. Embodiments of the present disclosure can include an attachment surface that can be a surface of a component (e.g., the bottom surface 104 of the tool body) or it can be a different surface that is coupled to the bottom surface 104 of the tool body. For example, in the various embodiments, the attachment surface is formed of hook and loop fasteners or releasable adhesives that can be utilized to releasably attach one or more of the components, (e.g., layers) of the tool 100 to one another.

For instance, in the embodiment of FIG. 1A, the tool 100 includes a pad layer 142 coupled to the bottom surface of base 132. The pad can have any shape and can be rigid, flexible, or resilient.

In the embodiment illustrated in FIG. 1A, the pad 142 includes side surfaces which are at right angles with respect to the bottom surface of the pad. However, as shown in FIGS. 2A and 2B, in various embodiments, the pad 142 can include side surfaces which are at non-right angles with respect to the bottom surface of the pad 142.

In the embodiment illustrated in FIG. 1A, the base layer 132 includes two side surfaces 133-1 and 133-2 which are at non-right angles with respect to the bottom surface of the base 132. In some embodiments, and as described herein, one or both of side surfaces 133-1 and 133-2 may be curved inward or outward as the surface progresses away from the bottom surface of the base 132 or as the surface progresses from one end of the tool to the other. Also, in some embodiments, the side surfaces 133-1 and 133-2 can have a serrated portion (e.g., a serrated edge). In such embodiments, a serrated side surface may be used, for example, to score an adjacent working surface such as a wall or ceiling.

In various embodiments, the use of fasteners, such as hook and loop fasteners, can provide for an efficient way to replace or detach various components from the tool 100. This allows the tool body to be equipped with various layered configurations. Variations can include the number of layers, the type of layers, the size and/or shape of the layers including the shape of the side surfaces of the layers, etc.

For example, a working material, such as sand paper configured to be releasably coupled to the tool using a hook and loop fastener, can be quickly replaced when the sand paper has become worn, when a different grit is to be used, or when a different type of working material is to be used. The attachment surfaces, including other surfaces of the components of the tool (e.g., a top and/or bottom surface), can include a number of other mechanical and/or chemical fastening mechanisms including but not limited to, glues, epoxies, clamps, and other attachment structures, to name a few.

Figure 1B:
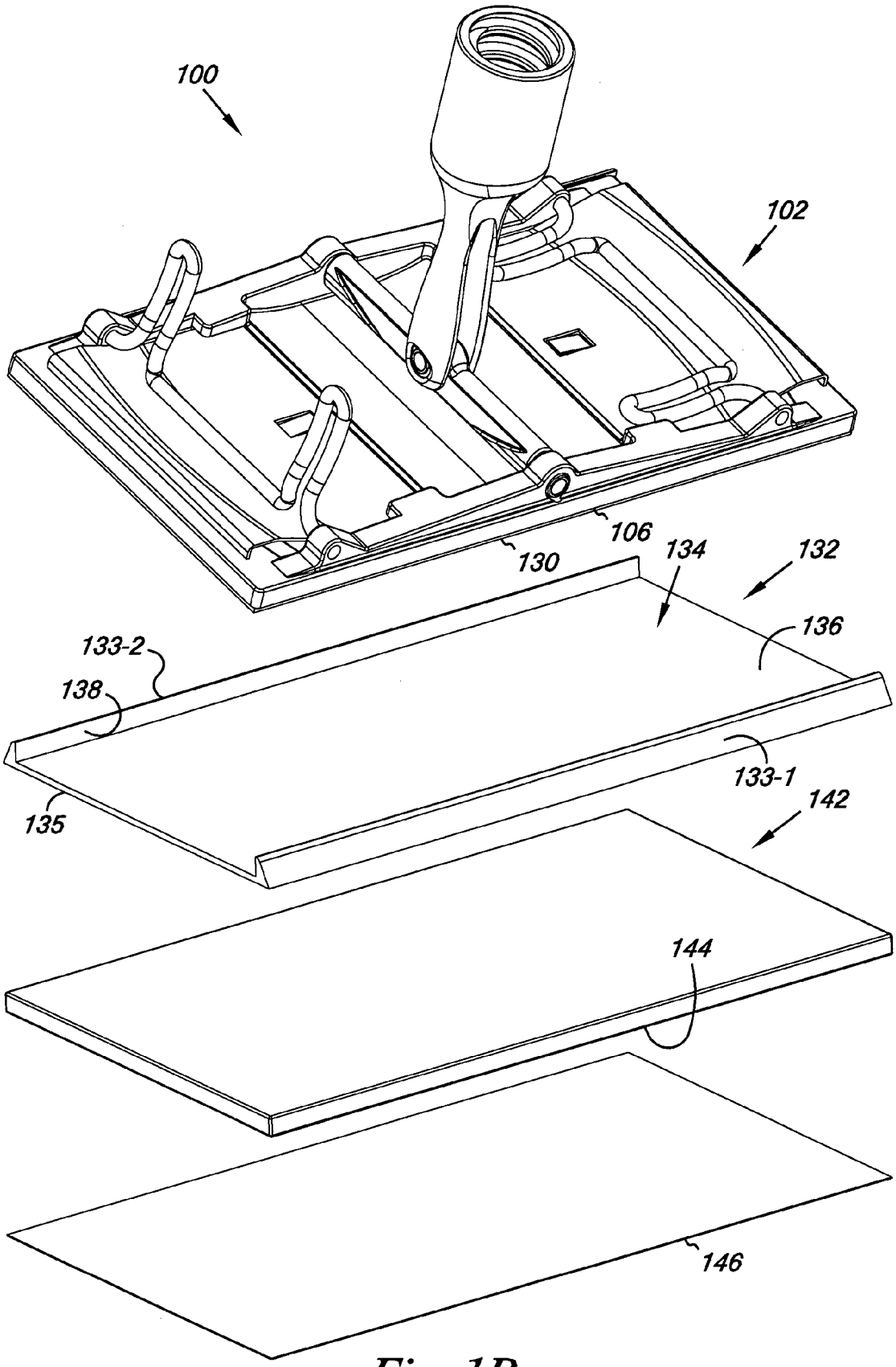
FIG. 1B illustrates an exploded top perspective view of the embodiment of FIG. 1.

FIG. 1B illustrates an exploded top perspective view of the embodiment of FIG. 1A. As shown in FIG. 1B, the tool 100 includes a tool body 102 as described with respect to FIG. 1A. In various embodiments, and as illustrated in FIGS. 1A and 1B, the tool 100 can include a base 132. In such embodiments, the base 132 can be formed of a variety of materials.

For example, in some embodiments, the base can be formed of resilient material to provide a flexible base that can compress, give, and/or bend when force is applied to the tool against an object or surface, such as a wall. In various embodiments, the flexible base 132 can have a density of about 600-900 $Kg/m^3$. In some embodiments, the base 132 can, for example, be made of a rubber material.

The use of a flexible base can provide a tactile feel to an operator of the tool 100 as well as increased comfort when using the tool 100. Another benefit is that a base formed of a resilient material can protect the tool from shock when the tool is dropped and can aid in reducing the tendency of the tool to flip when in use.

Figure 3A:
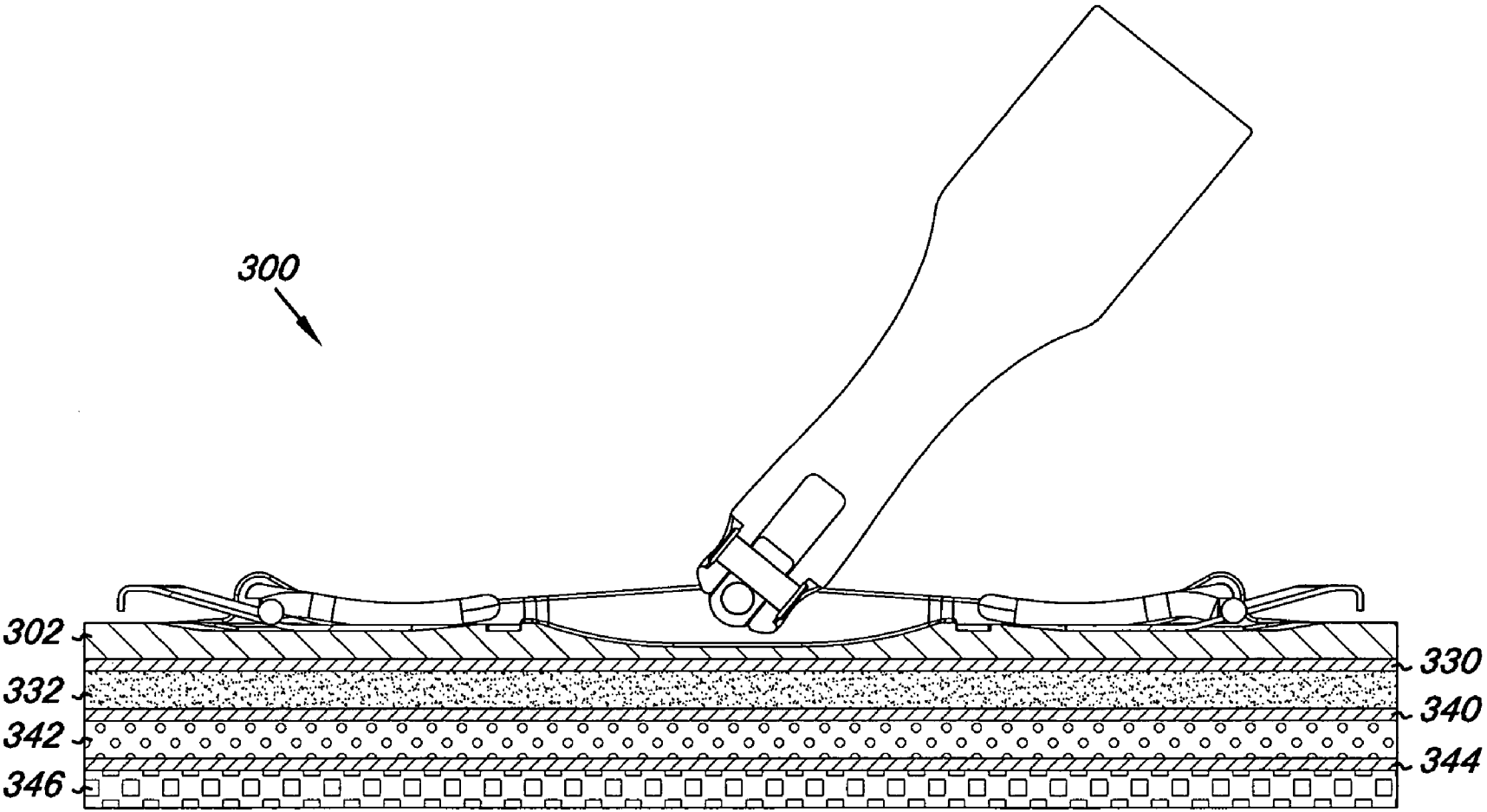
FIG. 3A illustrates a cut away side view of another embodiment of a tool.
Figure 3B:
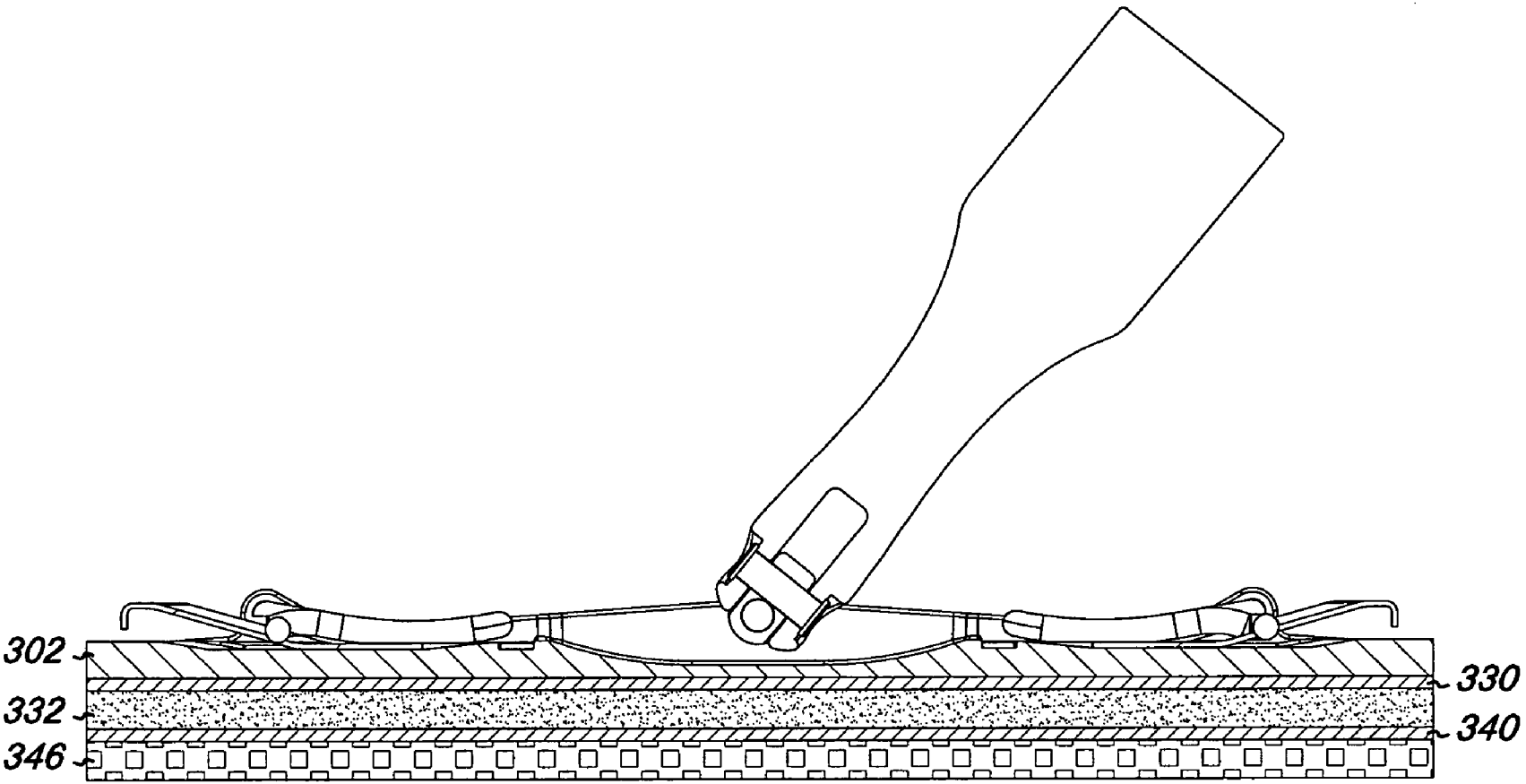
FIG. 3B illustrates a cut away side view of another embodiment of a tool.

In the embodiment of FIG. 1B, the base 132 includes a bottom surface 135 and a top surface 136. In various embodiments, the bottom surface 135 of the base can provide a second attachment surface (e.g., second attachment surface 340 as shown in FIGS. 3A and 3B) to which the base 132 of the tool can be releasably coupled to another component, as will be discussed below.

In various embodiments, the top surface of the base can define a recessed portion. In the embodiment illustrated in FIG. 1B, the recessed portion 134 is defined by the top surface 136 of the base 132 and is bounded by a wall 138 that extends upward from the top surface 136 toward the tool body 102.

The top surface 136, defining the recessed portion 134, can have a variety of shapes. In the embodiment shown in FIG. 1B, the top surface 136, defining the recessed portion 134, has a planar shape.

The recessed portion 134 can be provided in a variety of shapes. For example, in some embodiments, the recessed portion 134 can have a non-planar cross-sectional shape, such as a convex shape or a concave shape.

In various embodiments, and as shown in the embodiment of FIG. 1B, the bottom surface 135 of the base 132 and the top surface 136, defining the recessed portion 134 of the base, can be rectangular. Also, as illustrated in the embodiment of FIG. 1B, the top rectangular surface 136 can be smaller than the bottom rectangular surface 135, such that side surfaces 133-1 and/or 133-2 are at non-right angles (e.g., angled inward toward tool body 102 as shown) with respect to the bottom and/or top surfaces 135 and 136. As an example, in some embodiments, one or both of the side surfaces 133-1 and 133-2 can be angled at between about 15-30 degrees. In some embodiments, sides 133-1 and 133-2 can be angled by different amounts. Embodiments are not limited to sides 133-1 and 133-2 being oriented at a particular angle or range of angles. In other embodiments, the bottom surface 135 may be smaller than the top surface 136 such that the sides 133-1 and/or 133-2 are angled outward away from tool body 102.

In various embodiments, the base 132 can be releasably coupled to the tool body 102 via the first attachment layer 130 and/or attached to the bottom surface 106 (e.g., an attachment surface) of the tool body 102. For example, in various embodiments, the first attachment layer 130 can include a hook and loop fastener where the hook portion of the fastener is attached to or integrated with the bottom surface 106 of the tool body 102 and the loop portion of the fastener is attached to or integrated with the top surface 136 of the base 132, or vice versa.

In some embodiments, the base 132 can be frictionally attached to the tool body 102. For example, frictional force can be applied by top surface 136 and wall surfaces 138. In such embodiments, wall surfaces 138 can apply frictional force to side surfaces of tool body 102 (e.g., side surfaces 108-2 and 108-4 shown in FIG. 1A).

In various embodiments, the tool 100 can include a pad 142. The pad 142 can be formed from various materials, such as one or more rigid and/or resilient materials. In embodiments where the pad 142 is made from a resilient material (e.g., a sponge, foam, and/or rubber material, among other resilient materials), it can be utilized, for example, to cushion the force of the tool body 102 and base 132 on the surface being worked on, among other benefits. In such embodiments, the pad 142 can have a density of about 30-70 $Kg/m^3$, although embodiments are not limited to a particular density of pad 142.

In various embodiments, the density of the pad 142 is less than the density of the base 132 (e.g., the pad 142 is more flexible than the base 132). In such embodiments, the combination of a more flexible pad layer and less flexible base layer can provide various benefits.

For example, in some embodiments, the pad 142 can be made of an abrasive material (e.g., pad 142 can be a sanding pad) or the pad 142 can have an abrasive material releasably attached thereto. In such embodiments, the combination of a base layer 132 that is more rigid than the pad layer 142 can improve the finish of a surface being worked on, in some instances.

For instance, the base 132 can reduce or prevent a tendency for the tool body 102 to dig into a working surface through the pad layer 142 while it maintains the ability to remove imperfections such as large bumps and/or ridges in the working surface. In such embodiments, the less dense (e.g., more flexible) pad layer 142 can cushion the force of the more dense (e.g., less flexible) base layer 132 against the working surface, among other benefits.

In embodiments where the pad 142 is made from a rigid material, it can be utilized to distribute force more directly to the surface being worked on, among other benefits.

In various embodiments, the pad 142 can be releasably coupled to the base 132 via a second attachment surface (e.g., second attachment surface 340 as shown in FIGS. 3A and 3B) in the same manner as the base 132 is releasably coupled to the tool body 102, as described herein. As shown in the embodiment illustrated in FIG. 1B, a working material 146 can be releasably coupled to the pad 142 via a third attachment surface 144, as the same has been described herein.

In the embodiment of FIGS. 1A and 1B, the pad 142 has a rectangular shape with four side surfaces at right angles with respect to the top and bottom surfaces of the pad 142. Embodiments are not so limited.

For example, various other pad shapes and side surface orientations are possible. For instance, as described further below in connection with FIGS. 2A and 2B, the pad 142 can include side surfaces of various shapes and can include a recessed portion defined by the top surface of the pad and bounded by a wall surface of the pad.

FIGS. 2A and 2B illustrate a top perspective view and an exploded top perspective view, respectively, of another embodiment of a tool 200. In the embodiment shown, the tool 200 includes a tool body 202. As stated above, the tool body 202 can include a variety of shapes and sizes.

The tool 200 includes a number of components that stack above and below each other to form a number of layers of various components. In various embodiments, these components can have the same shape as the tool body, or one or more of the components can have different shapes.

For example, in some embodiments, the tool body 202 can be a rectangular shape while a base component, as will be discussed below, that can be coupled to the tool body 202, is a polygonal shape. That is, one or more of the top, bottom, or side surfaces of the base component can have various polygonal shapes according to embodiments of the present disclosure.

In the embodiment illustrated in FIGS. 2A and 2B, the top surface 204 of tool body 202 includes a concave portion 203 to receive a pivoting structure 210 to which a handle (e.g., handle 354 shown in FIG. 3C) can be pivotably coupled. The concave portion 203 of the top surface 204 provides a low attachment point for the pivoting structure 210 with respect to the top surface 204.

A low attachment point allows force to be applied at position close to the working surface, such as a wall or other such surface. When the device is operated far from the operator (e.g., via a long handle), this design can be beneficial in reducing the likelihood of flipping the device.

As one of ordinary skill in the art will appreciate, flipping the tool body 202 can result in damage to a working surface such as gouges in the working surface, scuff marks, etc. With embodiments in which flipping is reduced, the tool can be worked more quickly and, in some embodiments, more force can be applied due to the reduced likelihood that the tool will frictionally catch on the surface and flip.

In the example shown in FIG. 2B, the pivoting structure 210 includes a two-piece, two directional, structure similar to that described in connection with FIGS. 1A and 1B. In this embodiment, a first piece 212 having a first pivot point 213-1 is pivotally connected, via a first attachment member, to a second piece 214 having a second pivot point 213-2. The first piece 212 is pivotally connected to the tool body 202 within concave portion 203 via a second attachment member. In this embodiment, the first and second attachment members are rivets 211. The rivets 211 allow the pivoting structure 210 to move in a variety of directions when mounted to the tool body 202 as shown in FIG. 2A.

For instance, the first piece 212 can pivot around the first pivot point 213-1 and the second piece 214 can pivot around both the first and second pivot points 213-1 and 213-2 when the pivoting structure 210 is mounted to the tool body 202. Embodiments of the present disclosure are not limited to the use of pivotable attachment pieces illustrated in the embodiment of FIGS. 2A and 2B. For example, a ball joint, universal joint, or other joint type structure can be utilized. Further, in some embodiments, the handle can be fixed with respect to, or onto, the tool body 202. For example, a handle can be formed as part of the tool body or can be attached thereto.

In various embodiments, the tool 200 can include a first attachment surface (e.g. first attachment surface 130 shown in FIGS. 1A and 1B) that releasably couples the tool body 202 to another component of the tool, such as a base 232, for example. For example, in the various embodiments, the attachment surface is formed of hook and loop fasteners that can be utilized to releasably attach one or more of the components, (e.g., layers) of the tool 200 to one another.

In the embodiment illustrated in FIGS. 2A and 2B, the base 232 is attached to the tool body 202. In various embodiments, and as discussed above, the base 232 can be releasably coupled to the tool body 202. This can be accomplished via an attachment surface such as a hook and loop fastener attachment surface in which the hook portion of the fastener is attached to the bottom surface 206 of the tool body 202 and the loop portion of the fastener is attached to the top surface 236 of the base 232, or vice versa.

In some embodiments, the base 232 can be frictionally attached to the tool body 202. For example, frictional force can be applied by top surface 236 and the wall surfaces as described in the embodiment of FIGS. 1A and 1B. In such embodiments, wall surfaces can apply frictional force to side surfaces of tool body 202. Adhesive or mechanical attachment mechanisms can be used in some embodiments.

In the embodiment illustrated in FIGS. 2A and 2B, the tool 200 includes a pad layer 242 coupled to the bottom surface 235 of base 232. In various embodiments, the pad 242 can be releasably coupled to the base 232 via a second attachment surface (e.g., second attachment surface 340 as shown in FIGS. 3A and 3B) in the same or similar manner as the base 232 is releasably coupled to the tool body 202, as described herein. In the embodiment of FIGS. 2A and 2B, the pad 242 includes a bottom surface 244 and a top surface 249. In various embodiments, the bottom surface 244 of the pad can provide a third attachment surface (e.g., third attachment surface 344 as shown in FIG. 3A) to which the pad 242 and another component of the tool (e.g., a working material) can be releasably coupled.

The pad 242 can be formed from various rigid and/or resilient materials. In embodiments where the pad 242 is a resilient material, it can be utilized, for example, to cushion the force of the tool body 202 and base 232 on the surface being worked on.

As mentioned above, in some embodiments, the pad 242 can have a density of about 30-70 $Kg/m^3$. The pad 242 can be less dense than the base 232, in various embodiments. As an example, the base 232 can have a density of about 800 $Kg/m^3$.

In such embodiments, the combination of a more flexible pad layer and less flexible base layer can provide various benefits. As one example benefit, the combination of a more flexible pad layer 242 and less flexible base layer 232 can improve the finish of and/or prevent damage to a working surface in corners and/or edge surfaces (e.g., inside corners and/or edges between adjacent walls), in some instances. For instance, in various embodiments, the less flexible (e.g., more dense) base 232 can reduce or prevent the rigid tool body 202 from digging into a corner surface through the pad 242 due to pressure applied to the tool body 202. Additionally, in embodiments where the pad 242 is a rigid material, it can be utilized to distribute force more directly to the surface being worked on.

In various embodiments, and as shown in FIG. 2B, the top surface 249 can define a recessed portion 247. The recessed portion 247 is defined by the top surface 249 of the pad 242 and is bounded by walls 248 that extend upward from the top surface 249 toward the tool body 202.

Also, as illustrated in the embodiment of FIG. 2B, the top rectangular surface 249 can be smaller than the bottom rectangular surface 244, such that side surfaces 243-1 and/or 243-2 are at non-right angles. As an example, in some embodiments, one or both of the side surfaces 243-1 and/or 243-2 can be angled at between about 15-30 degrees.

In the embodiment illustrated in FIG. 2B, a first side surface 243-1 of pad 242 is a serrated surface, and a second side surface 243-2 of pad 242 is a curved (e.g., rounded) surface. In various embodiments, a serrated side surface and/or a curved side surface (e.g., with an abrasive material provided thereon) may, for example, be used to score an adjacent working surface such as a wall or ceiling, for example. The side surfaces 243-1 and 243-2 of pad 242 can have various other shapes and/or orientations, such as those described herein in connection with FIGS. 1A-1B and 3A-7C, among others. In some embodiments, the bottom surface 244 may be smaller than the top surface 249.

In various embodiments, the use of fasteners, such as hook and loop fasteners, can provide for an efficient way to replace or detach various components from the tool 200. This allows the tool body to be equipped with various layered configurations. Variations can include the number of layers (e.g., one or more layers attached to the tool body), the type of layers (e.g., base layer, pad layer, attachment layer, working material layer), the size and/or shape of the layers including the shape of the side surfaces of the layers, etc.

Figure 3C:
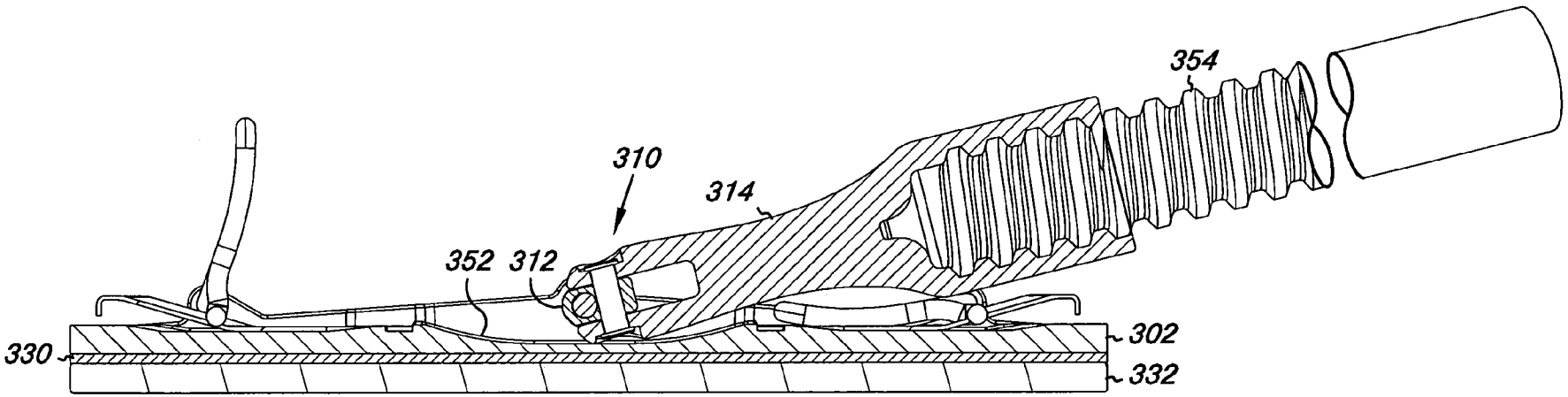
FIG. 3C illustrates a cut away side view of another embodiment of a tool.

FIGS. 3A, 3B, and 3C each illustrate a cut away side view of another embodiment of a tool 300. In the embodiments of FIGS. 3A-3C, the tool 300 includes various configurations of layered components releasably coupled to the tool body 302 via attachment surfaces.

For example, in the embodiment shown in FIG. 3A, the tool 300 includes a tool body 302, a first attachment surface 330, and a base 332 releasably coupled to the first attachment surface 330. Also shown in FIG. 3A is a second attachment surface 340 of the base 332 and a pad 342 releasably coupled to the second attachment surface 340. The third attachment surface 344 of the pad is also illustrated in FIG. 3A with a working material 346 releasably coupled to the third attachment surface 344.

In various embodiments, the pad 342 can have a working material formed on the pad 342, or the pad 342 can be constructed of a working material 346 and, therefore, there would be no need for the third attachment surface 344 to be utilized between the pad 342 and the working material 346. In addition, in the embodiment illustrated in FIG. 3A, the attachment surfaces and other surfaces of the components can utilize various mechanical, or chemical, coupling mechanisms. For example, in some embodiments, the bottom surface of the tool body and the top surface of the base can be coupled using an adhesive, such as an epoxy, to form the first attachment surface.

FIG. 3B illustrates a cut away side view of another embodiment of a tool. The configuration of the tool shown in FIG. 3B includes a tool body 302 releasably coupled to a base 332 via a first attachment surface 330. A working material 346 releasably coupled to the base 332 with a second attachment surface 340 is also illustrated in FIG. 3B. One of ordinary skill in the art will appreciate that the base 332 can have a working material formed on the base 332, or that the base 332 can be constructed of a working material 346, and therefore there would be no need for the second attachment surface 340 to be utilized between the base 332 and the working material 346.

FIG. 3C illustrates a cut away side view of another embodiment of a tool. In various embodiments, the tool illustrated in FIG. 3C can include components such as those described in FIGS. 1A, 1B, 2A, 2B, 3A, and 3B. For example, the tool can include a base 332 releasably coupled to a tool body 302 via a first attachment surface 330.

In various embodiments, the tool body 302 includes a top surface that can also include many of the same mechanisms as those described in connection with the top surface 104 of FIG. 1A. For example, the top surface can include the fastening member 116 as described in connection with FIG. 1A.

In the embodiment of FIG. 3C, the top surface of the tool body 302 defines a concave portion 352 into which a pivoting structure 310 is mounted. As shown in FIG. 3C, the pivoting structure 310, such as the pivoting structure 110/210 described in FIGS. 1A-2B, is positioned within the concave portion 352 of the top surface. The pivoting structure 310 includes a first piece 312 and a second piece 314. As discussed herein with respect to FIGS. 1A-2B, a first piece 312 can be used to allow a handle 354, which can be rotatably threaded to the second piece 314, to pivot radially with respect to the attachment point of the handle 354 coupled to the tool body 302. As described above, the first piece 312 can be coupled to the tool body 302 with a suitable attachment member such as a rivet (e.g., rivet 211 shown in FIG. 2B). Similarly, the second piece 314 can be coupled to the first piece 312 with a suitable attachment member such as a rivet (e.g., rivet 211 shown in FIG. 2B), as shown in the embodiment of FIG. 3C.

The concave portion 352 of the top surface provides a low attachment point for the pivoting structure 310 with respect to the top surface. A low attachment point allows force to be applied at a position close to the working surface, such as a wall or other such surface. When the device is operated far from the operator (e.g., via a handle 354), this design can be beneficial in reducing the likelihood of flipping the device. As one of ordinary skill in the art will appreciate, flipping the tool body 302 can result in damage to a working surface such as gouges in the working surface, scuff marks, etc.

When a low attachment point is coupled with a wide cross-section of the tool in at least one dimension (typically the dimension in which the tool is to be moved to work the surface), these two elements can further reduce the tendency for the device to flip. With embodiments in which flipping is reduced, the tool can be worked more quickly and in some embodiments more force can be applied due to the reduced likelihood that the tool will frictionally catch on the surface and flip.

In some embodiments, generally uniform diameters of the working material can also allow the tool to be moved in any direction to work a surface with a reduced risk of flipping. For example, circular, square, pentagonal, and hexagonal shapes, among others, provide a generally uniform diameter with respect to the point of connection of the handle, thereby, allowing the tool to be moved in any direction with similar risk of flipping.

Figure 4:
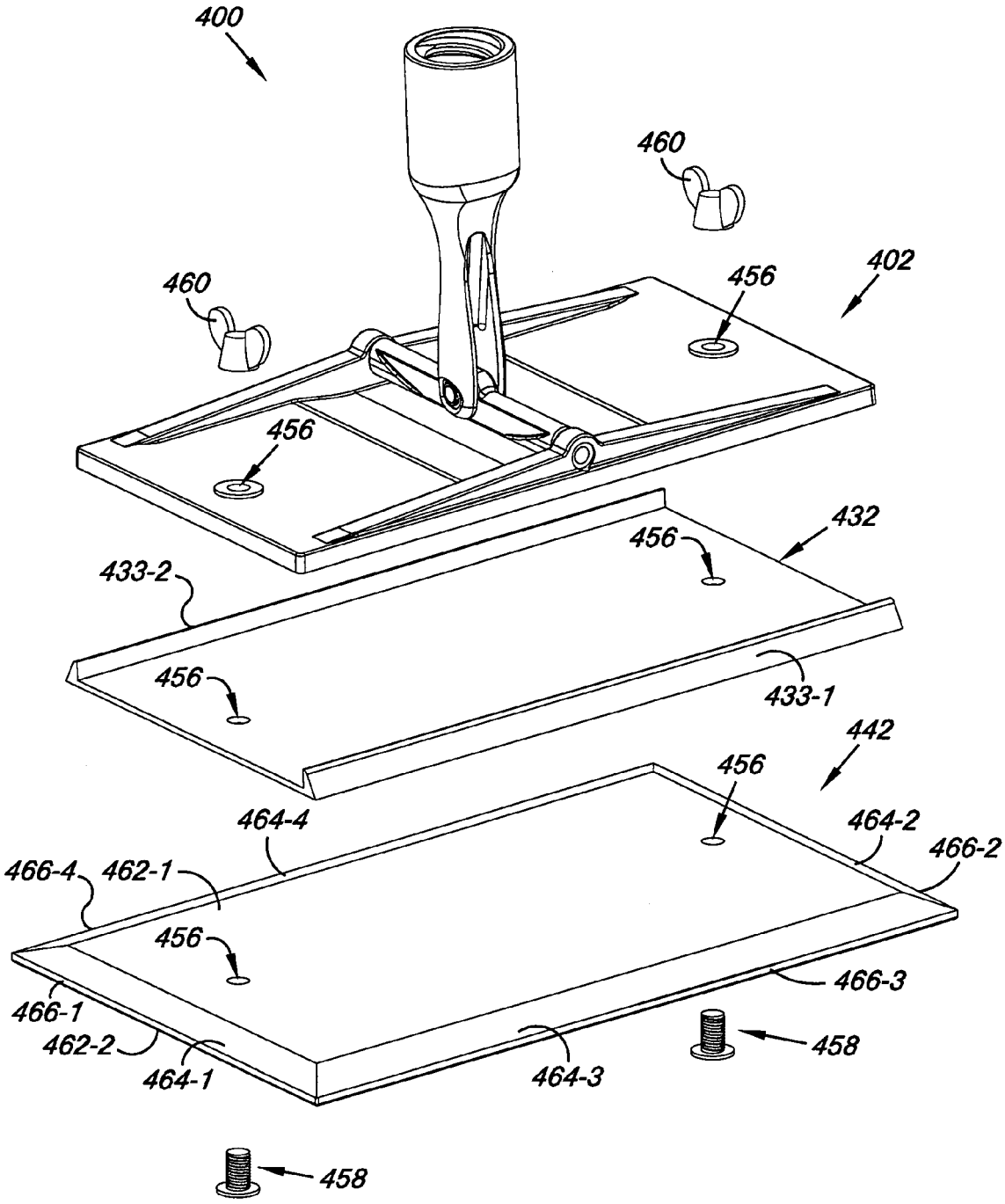
FIG. 4 illustrates an exploded perspective view of another embodiment of a tool.

FIG. 4 illustrates an exploded perspective view of another embodiment of a tool. As shown in FIG. 4, the tool 400 includes a number of releasably coupled components (e.g., a tool body 402, a base 432, and a pad 442). In various embodiments, other components of a tool as described herein can be included. For example, attachment surfaces and a working material, as discussed herein, can also be provided. In this embodiment, each of the components includes surfaces that define openings 456.

When the components are layered upon one another, the openings 456 are in alignment such that a fastener can be extended through the openings to releasably couple the components of the tool 400. For example, as shown in the embodiment of FIG. 4, a bolt 458 can be extended through the openings 456 in each of the tool body 402, base 432, and pad 442 and secured by a wing nut 460.

As previously described herein, the base 432 can include various configurations and shapes and can be formed of various materials. In the embodiment illustrated in FIG. 4, the base 432 includes two angled side surfaces 433-1 and 433-2.

The pad 442 can include various configurations and shapes. In various embodiments, the configurations and shapes can include surfaces that bound each other at non-right angles. For example, the pad 442 is shaped in the form of a polyhedron having surfaces that bound each other at non-right angles. In the embodiment of FIG. 4, two surfaces 462-1 and 462-2 (e.g., the top and bottom surfaces of pad 442, respectively) of the pad form a rectangular shape and four surfaces 464-1-464-4 (e.g., the four side surfaces) of the pad form a trapezoidal shape.

In various embodiments, the surfaces 464-1-464-4 incline at an angle from edges 466-1-466-4 and toward surface 462-1. Embodiments can utilize various angles of inclination. For example, in some embodiments, the angle of inclination of the surfaces 464-1-464-4 is 45 degrees. And, in other embodiments, the angle of incline can be more than 45 degrees (e.g., 60 or 70 degrees) or less than 45 degrees (e.g., 30 or 20 degrees). In addition, the angle of incline can vary among the surfaces. For example, a number of surfaces can have an angle of 45 degrees, while a number of surfaces can have an angle of 60 degrees.

In some embodiments, one or more of the edge surfaces 466-1-466-4 can include a serrated edge such as serrated side surface 243-1 shown in FIG. 2B. In such embodiments, the one or more serrated edges can be used for various purposes such as to score on adjacent wall surface and/or ceiling surface, among other purposes. Embodiments are not limited to the shapes of the side surfaces 464-1-464-4 and edge 466-1-466-4 shown in FIG. 4. For instance, one or more of the side surfaces and or edges may be rounded such as side surface 243-2 shown in FIG. 2B.

A working material can be releasably coupled to the tool 400 in a number of ways. In various embodiments, a working material can be wrapped around a number of the edges 466-1-466-4 and fitted tightly against a number of the surfaces 464-1-464-4.

In some embodiments, the working material can be secured to the tool 400 by extending the bolt 458 through a portion of the working material at the top surface 404 of the tool body 402 and tightened with a nut, e.g., wing nut 460. In such an embodiment, because the surfaces 464-1-464-4 angle at an incline toward surface 462-1, the working material attached thereto may not contact surfaces adjacent to those being sanded, such as adjacent walls at a corner, a ceiling and wall, a floor and a wall, etc., thus the possibility of gouging or scoring a surface adjacent to a surface being sanded can be reduced.

Figure 5A:
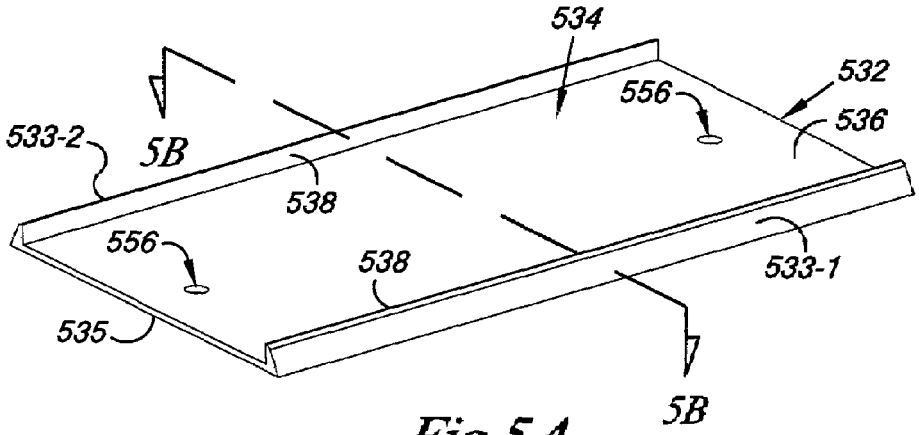
FIG. 5A illustrates a top perspective view of an embodiment of a material layer shape.
Figure 5B:
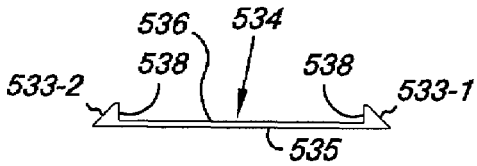
FIG. 5B illustrates a cut away view of the embodiment of FIG. 5A taken along line 5B-5B.

FIG. 5A illustrates a top perspective view of an embodiment of a material layer shape. FIG. 5B illustrates a cut away view of the embodiment of FIG. 5A taken along line 5B-5B.

FIGS. 5A and 5B illustrate an embodiment of a base component 532. As described above, the base 532 can be formed of a variety of materials. For example, in some embodiments, the base can be formed of resilient material to provide a flexible base that can compress, give, and/or bend when force is applied to the tool against an object or surface, such as a wall.

The use of a flexible base can provide a tactile feel to an operator of a tool to which the base is attached as well as increased comfort when using the tool. Another benefit is that a base formed of a resilient material can protect the tool from shock when the tool is dropped. In some embodiments, the base 532 can be formed of a rigid material which can provide benefits such as distributing force more directly to a surface being worked on.

In the embodiment of FIGS. 5A and 5B, the base 532 includes a bottom surface 535 and a top surface 536. In various embodiments, the bottom surface 535 of the base can provide a second attachment surface (e.g., second attachment surface 340 as shown in FIGS. 3A and 3B) to which the base 532 and/or another component of the tool can be releasably coupled. In this embodiment, the base 532 includes openings 556 through the bottom and top surfaces 535 and 536 which can be used to secure the base 532 to one or more tool component layers via a bolt and wing nut or other suitable fastening mechanism.

As shown in FIGS. 5A and 5B, the top surface 536 can define a recessed portion 534. In this embodiment, the recessed portion 534 is defined by the top surface 536 of the base 532 and is bounded by walls 538 that can extend upward (e.g., vertically) from the top surface 536, for example, at a right angle. In some embodiments, the walls 538 can be angled inward or outward with respect to the bottom and/or top surfaces 535 and 536.

The top surface 536, defining the recessed portion 534, can have a variety of shapes. In the embodiment shown in FIG. 5B, the top surface 536, defining the recessed portion 534, has a planar shape. The recessed portion 534 can be provided in a variety of shapes. For example, in some embodiments, the recessed portion 534 can have a non-planar cross-sectional shape, such as a convex shape or a concave shape. A recessed portion having a non-planar cross-sectional shape can be beneficial for use of the tool on non-planar (e.g., rounded or curved) working surface.

In the embodiment illustrated in FIGS. 5A and 5B, the base 532 includes two side surfaces 533-1 and 533-2, which are at non-right angles with respect to the bottom and/or top surfaces 535 and 536. In some embodiments, one or more of side surfaces 533-1 and 533-2 can be a rounded or a serrated surface such as serrated side surface and/or rounded side surface as described in connection with pad layer 242 of FIG. 2B. In some embodiments, the base 532 can have more than two side surfaces. For instance, in some embodiments, base 532 can have four side surfaces which can provide a shape, such as a closed rectangular recess in the middle formed by the four side surfaces.

Figure 6A:
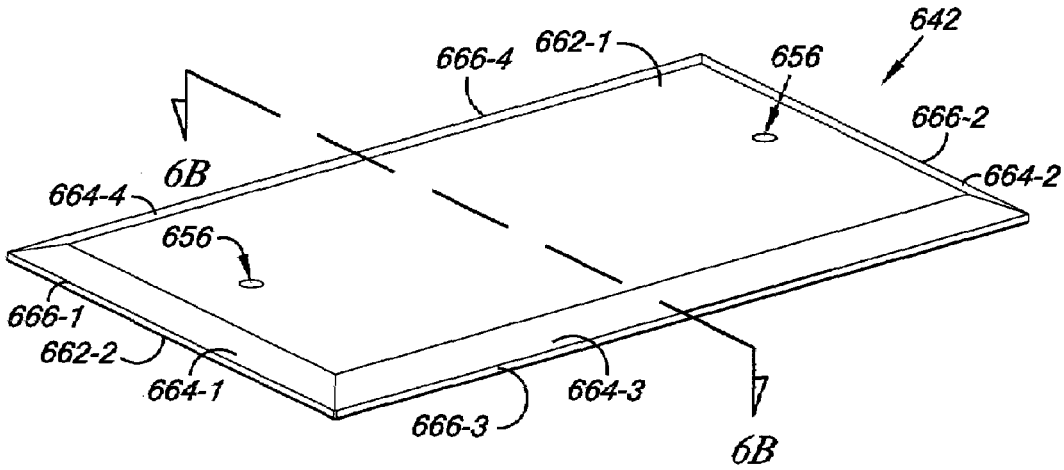
FIG. 6A illustrates a top perspective view of an embodiment of a material layer shape.
Figure 6B:
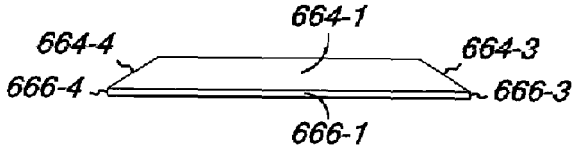
FIG. 6B illustrates a cut away view of the embodiment of FIG. 6A taken along line 6B-6B.

FIG. 6A illustrates a top perspective view of an embodiment of a material layer shape. FIG. 6B illustrates a cut away view of the embodiment of FIG. 6A taken along line 6B-6B.

FIGS. 6A and 6B illustrate an embodiment of a pad component 642. As described previously herein and further below in connection with FIGS. 7A-7C, the pad 642 can be formed of a variety of materials and can include various configurations and shapes. For example, in this embodiment, the pad 642 is shaped in the form of a polyhedron having surfaces that bound each other at non-right angles. In the embodiment of FIGS. 6A and 6B, two surfaces 662-1 and 662-2 (e.g., the top and bottom surfaces of pad 642, respectively) form a rectangular shape and four surfaces 664-1-664-4 (e.g., the four side surfaces) of the pad 642 form a trapezoidal shape.

The pad 642 can be formed from various rigid and/or resilient materials. In embodiments where the pad 642 is a resilient material, it can be utilized, for example, to cushion the force of a tool body and base layer on the surface being worked on. In embodiments where the pad 642 is a rigid material, it can be utilized to distribute force more directly to the surface being worked on. In some embodiments, the pad 642 can be fabricated from a working material.

In various embodiments, and as shown in FIGS. 2A, 2B, and 4 for example, a top surface of the pad 642 can define a recessed portion defined by the top surface of the pad and bounded by walls that extend vertically from the top surface toward a tool body.

In the embodiment of FIGS. 6A and 6B, and as described in connection with FIG. 4, the surfaces 664-1-664-4 incline at an angle from edges 666-1-666-4 and toward surface 662-1. Embodiments can utilize various angles of inclination. For example, in some embodiments, the angle of inclination of the surfaces 664-1-664-4 is 45 degrees. And, in other embodiments, the angle of incline can be more than 45 degrees (e.g., 60 or 70 degrees) or less than 45 degrees (e.g., 30 or 20 degrees). In addition, the angle of incline can vary among the surfaces. For example, a number of surfaces can have an angle of 45 degrees, while a number of surfaces can have an angle of 60 degrees.

In some embodiments, one or more of the edge surfaces 666-1-666-4 can include a serrated edge such as serrated side surface 243-1 shown in FIG. 2B. In such embodiments, the one or more serrated edges can be used for various purposes such as to score on adjacent wall surface and/or ceiling surface, among other purposes. Embodiments are not limited to the shapes of the side surfaces 664-1-664-4 and edge 666-1-666-4 shown in FIGS. 6A and 6B. For instance, one or more of the side surfaces and or edges may be rounded such as side surface 243-2 shown in FIG. 2B.

A working material can be releasably coupled to the pad 642 in a number of ways. In various embodiments, a working material can be wrapped around a number of the edges 666-1-666-4 and fitted tightly against a number of the surfaces 664-1-664-4. In some embodiments, the working material can be secured to pad 662 by extending a bolt through a portion of the working material and through openings 656 in pad 642 and securing it with a nut, for example. A working material can also be releasably coupled to the bottom surface 662-2 of pad 642 via one or more attachment surfaces (e.g., hook and loop attachment layers) as described herein.

FIGS. 7A-7C illustrate various embodiments of a pad 770 according to the teachings of the present disclosure. FIG. 7A illustrates a top view of an embodiment of a component of a tool. FIG. 7B illustrates a cross-sectional view of an embodiment similar to that illustrated in FIG. 7A that includes a recess 768 formed in the bottom surface 762-2 of the component. And, FIG. 7C illustrates a cross-section view of an embodiment similar to that illustrated in FIG. 7B that includes a filler material 774.

In various embodiments, and as illustrated in FIG. 7A, pad 770 includes a top surface 762-1 having a rectangular shape and four side surfaces 764-1-764-4 each having a trapezoidal shape. In various embodiments, the four side surfaces 764-1-764-4 decline at an angle from the top surface 762-1 and toward side edges 766-1-766-4. In various embodiments, the angle of decline can be equal among the four surfaces 764-1-764-4 or the angle of decline can vary among the four surfaces 764-1-764-4.

The top surface 762-1 and four side surfaces 764-1-764-4 can include various shapes. For example, in the embodiment shown in FIG. 7A, the top surface and four side surfaces are planar shapes. However, in various embodiments, these surfaces can include other shapes. For example, in some embodiments, the top surface and side surfaces can include non-planar surfaces, such as convex or concave surfaces.

As shown in the embodiments of FIGS. 7B and 7C, the pad 770 includes a top surface 762-1 and a bottom surface 762-2. In various embodiments, the bottom surface 762-2 can include a recessed portion 768. The recessed portion 768 is bounded by walls 772 that extend vertically from the recessed portion 768, in the embodiment illustrated in FIGS. 7B and 7C.

The bottom surface 762-2 defining the recessed portion 768 can be a variety of shapes. In the embodiment shown in FIGS. 7B and 7C, the bottom surface 762-2 defining the recessed portion 768, has a planar shape (e.g., a flat rectangle in this embodiment). However, in various embodiments, the recessed portion 768 can have other shapes. For example, in some embodiments, the recessed portion 768 can have a non-planar shape such as a convex shape or a concave shape.

In various embodiments, the walls 772 extend vertically from the recessed portion 768 and away from the top surface 762-1 of the pad 770. In the embodiment of FIG. 7B, the walls 772 extend perpendicularly from recessed portion 768. In various embodiments, however, the wall 772 can extend from the recessed portion at other angles (e.g., 30 degrees, 45 degrees, 60 degrees, etc.).

The walls 772 can have a variety of shapes. In the embodiments shown in FIGS. 7B and 7C, the surfaces of the walls 772 have a planar shape. In various embodiments, the surfaces of the walls 772 can have a curved shape, as for example, a convex or a concave shape.

In various embodiments, a periphery 763 of the pad 770 forms a portion of the bottom surface 762-2. As shown in FIGS. 7B and 7C, the periphery 763 of pad 770 can be bounded by side edges 764-1-764-4 (764-1 and 764-3 are shown) and walls 772. In various embodiments, the periphery 763 of the pad 770 can be formed of a material having a lower resiliency than other components of the pad, e.g., a filler material as will be discussed below with respect to the embodiment of FIG. 7C. In such embodiments, the periphery 763 of pad 770 can help to provide structural support to the pad 770 and to distribute force more directly to a surface being worked on.

In some embodiments, the pad 770 can have a resiliency such that it is semi-rigid. In such embodiments, it can provide support to a working material but may be resilient enough to act as a bumper to not mar surfaces in which it comes in contact.

Referring now to FIG. 7C, in various embodiments, the pad 770 can include a filler material 774. In various embodiments, the filler material 774 can be releasably coupled to the pad within the recessed portion 768. In the embodiment of FIG. 7C, the filler material 774 extends from the recessed portion 768 and past the periphery 763 of bottom surface 762-2 of the pad 770. The use of filler materials in recesses can provide unique forces when applied to a working surface.

However, in various embodiments, the filler material 774 can be flush with the bottom surface 762-2 of the pad. In such embodiments, a first surface of the filler material 774 can be releasably coupled to the bottom surface 762-2 defining the recessed portion 768 via an attachment surface. And, a second surface of the filler material 774 can be flush with the periphery 763 of the bottom surface 762-2.

In various embodiments, the filler material 774 can include a variety of shapes. For example, the filler material can be provided in various circular, oval, polygonal, and other symmetrical and irregular shapes and can have a planar or contoured top and/or bottom surface.

In various embodiments, the filler material 774 can include a resilient and/or a rigid material. For example, in various embodiments, the filler material 774 can be formed from a resilient material such as sponge, foam, and/or rubber materials. And in some embodiments, the filler material 774 can be formed of a rigid material such metal or plastic. Embodiments are not limited to the materials discussed herein.

In embodiments where the filler material 774 includes a flexible material, such as foam, and extends past the bottom surface, as for example, in the embodiment shown FIG. 7C, the filler material can function to cushion the force of a tool body and/or base releasably coupled to the pad on the surface being worked on. A flexible filler material can also help to provide comfort when using the pad to work on surfaces.

In various embodiments, the filler material 774 can be fabricated from a working material, as the same has been described herein. In some embodiments, the filler material 774 can have an attachment surface thereon to which a working material can be releasably coupled, as discussed herein. For example, in various embodiments, the bottom surface of filler material 774 can provide an attachment surface such as hook and loop fasteners such that a working material can be releasably coupled thereto.

In various embodiments, pad 770 can be releasably coupled to a component of a tool, as the same has been described herein. For example, the top surface 762-1 of pad 770 can be releasably coupled to a tool body via a first attachment surface, such as the tool body and first attachment surface illustrated in FIGS. 1A-3C.

In various embodiments, pad 770 can be releasably coupled to a base via a second attachment surface, such as base and second attachment surface illustrated in FIGS. 3A-4. In such embodiments, the base including the releasably coupled pad can be releasably coupled to the tool body. For example, pad 770 can be releasably coupled to base 432 illustrated in FIG. 4 with the use of the bolt 458 and wing nut 460 or other fastening mechanism (e.g., hook and loop fasteners as discussed herein).

In such an embodiment, the bolt 458 can be designed such that an end of the bolt fits flush with the bottom surface 762-2 defining the recessed portion 768 of the pad 770 so as not to obstruct the filler material 774 releasably coupled to the bottom surface 762-2 within the recessed portion 768. A flush arrangement can also provide a uniform bottom surface of filler material 774 on which the working material is mounted. Therefore, the working material provides substantially uniform pressure on the surface being worked.

Various tool embodiments discussed herein can utilize the layered structure to provide the operator with a tool that has a more cushioned force applied to a working surface. For example, tools utilizing one or more resilient layers can provide such functionality.

Further, the use of one or more rigid layers can provide a more direct translation of force from the handle of the tool to the working surface. Rigid layers can also provide a force to support the number of resilient layers provided thereon. Additionally, the use of one or more resilient layers behind one or more rigid layers, can allow the tool working surface, although rigid, to float somewhat to conform to changes in the working surface, among other uses.

Further, the use of resilient materials can provide one or more small additional working forces. For example, when the resilient layers of the tool are compressed when force is applied in a direction of movement of the tool across a working surface, the resilient layers are deformed. When that force is released, the resilient layers of the tool return generally to their original form.

This reforming motion can be used, in some instances, as an added force to the working surface. This can be beneficial, for example, when sanding a corner, wherein the motion provides a small extra sanding force to the corner area. When multiple layers with the same or different amounts of resiliency are used, multiple different forces can be combined to provide unique force behaviors. By using replaceable layers, a user can change the number, type, size, shape, or other aspects of the layers being used to adjust the forces to be used on a working surface.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

It is emphasized that the Abstract is provided to comply with 37 C.F.R. § 1.72(b) requiring an Abstract that will allow the reader to quickly ascertain the nature of the technical disclosure. It is submitted with the understanding that it will not be used to limit the scope of the claims.

In the foregoing Detailed Description, various features are grouped together in a single embodiment for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A tool, comprising:

a non-motorized, non-rotary tool body having a top surface and a bottom surface, the top surface having a receiver for receiving a handle;

a resilient and compressible base having a top surface and a bottom surface, wherein the top surface of the base is releasably attached to the bottom surface of the tool body via a first attachment layer, the base including:

the top surface of the base defining a recessed portion to receive the tool body; and a side surface defining a shock absorbing bumper and being at a non-right angle with respect to the bottom surface of the base to reduce risk of damage to a surface adjacent to a working surface when the tool is applied to a working surface; and wherein the base is formed of a compressible material having a density not greater than 900 Kg/m$^3$ to provide a tactile feel and increased comfort to an operator of the tool when force is applied against the working surface;

a pad attached to the base via a second attachment layer, the pad formed of a material having a density less than the density of the base; and a working material releasably attached to the pad via a third attachment layer.

2. The tool of claim 1, where at least one of the attachment layers includes a hook and loop fastening material.

3. The tool of claim 1, where the density of the material forming the base is in a range of 600-900 Kg/m$^3$.

4. The tool of claim 3, where the density of the material forming the pad is in a range of 30-70 Kg/m$^3$.

5. The tool of claim 1, where the density of the material forming the pad is in a range of 30-70 Kg/m$^3$.

6. The tool of claim 1, where the pad has two side surfaces and where each side surface is angled at twenty degrees from a bottom surface of the pad.

7. The tool of claim 6, where the base has two side surfaces and where each side surface is angled at twenty degrees from the bottom surface of the base.

8. The tool of claim 1, where the pad includes a number of side surfaces and where all of the side surfaces are at non-right angles to a bottom surface of the pad.

9. The tool of claim 8, where each side surface has an end that intersects an end of another side surface and where the ends intersect at a non-right angle.

10. The tool of claim 1, where the pad includes six surfaces and where two surfaces of the pad are rectangular in shape and four surfaces of the pad are trapezoidal.

11. The tool of claim 1, where the pad is sized having a periphery at least as large as a periphery of the base.

12. The tool of claim 1, where the tool body includes a concave portion in an upper surface of the tool body into which a pivoting structure is mounted.

13. The tool of claim 1, where a portion of the working material wraps around the pad and where a portion of the working material is positioned between the base and the pad.

14. The tool of claim 1, where the pad includes a surface defining a recessed portion to receive the base.

15. The tool of claim 1, where the pad includes a top surface defining a recessed portion to receive the base, and where at least one side surface of the pad is a curved edge surface.

16. The tool of claim 1, where the pad includes a top surface defining a recessed portion to receive the base, and where at least one side surface of the pad includes a serrated side surface.

17. A tool, comprising:

a tool body having a top surface and a bottom surface, where the top and bottom surfaces are connected by a side surface;

a flexible base releasably attached to the tool body having a top surface, a side surface, and a bottom surface, the top surface defining a recessed portion sized to accommodate the bottom surface of the tool body and to attach thereto via an attachment layer, the side surface sized and arranged to define a shock absorbing bumper; and a pad releasably attached to the flexible base, the pad including a top surface defining a recessed portion sized to accommodate the bottom surface of the flexible base.

18. The tool of claim 17, where the pad releasably attached to the flexible base includes a working material formed thereon.

19. The tool of claim 17, where the pad is formed of a resilient material.

20. The tool of claim 17, where the pad is formed of a rigid material.

21. A method, comprising:

applying a tool to a working surface wherein the tool includes:

a tool body having a top surface and a bottom surface, the top surface for receiving a handle and the bottom surface is a first attachment surface;

a flexible base having a top surface and a bottom surface, wherein the bottom surface is a second attachment surface, and wherein the top surface of the base defines a recessed portion to receive the tool body and is releasably attached to the bottom surface of the tool body via the first attachment surface, and wherein the base includes at least one side shock absorbing bumper surface configured to reduce risk of damage to a surface adjacent to the working surface, and wherein the base is formed of a compressible material having a density which provides a tactile feel and increased comfort to an operator of the tool when force is applied against the working surface;

a pad having a third attachment surface, the pad:

is formed of a material having a density less than the density of the flexible base;

includes a surface defining a recessed portion to receive the flexible base; and includes a working material formed thereon;

and advancing the tool in one or more directions across the working surface.

22. The method of claim 21, including releasably coupling to at least one of the first, second, and third attachment surfaces via at least one of the fasteners selected from the group including:

a hook and loop material;

a releasable adhesive;

a compression clamp;

a screw; and a bolt and nut.

* * * * *